US007266935B2

(12) United States Patent
Fox et al.

(10) Patent No.: US 7,266,935 B2
(45) Date of Patent: Sep. 11, 2007

(54) CASE SEALER ASSEMBLY WITH SPRING-LOADED SIDE DRIVE MECHANISMS

(75) Inventors: Bryce J. Fox, Honesdale, PA (US); Robert Cheich, Independence, OH (US)

(73) Assignee: Illinois Tool Works Inc., Glenview, IL (US)

( * ) Notice: Subject to any disclaimer, the term of this patent is extended or adjusted under 35 U.S.C. 154(b) by 32 days.

(21) Appl. No.: 11/322,397

(22) Filed: Jan. 3, 2006

(65) Prior Publication Data

US 2007/0151207 A1 Jul. 5, 2007

(51) Int. Cl.
*B65B 15/14* (2006.01)
*B65B 61/00* (2006.01)

(52) U.S. Cl. ..... 53/136.4; 493/475; 493/479; 198/626.4

(58) Field of Classification Search ..... 53/136.4; 198/626.3, 626, 836.3; 493/475, 479
See application file for complete search history.

(56) References Cited

U.S. PATENT DOCUMENTS 2,808,693 A * 10/1957 Guggenheim ..... 53/393
4,161,138 A * 7/1979 Marchetti ..... 493/117
4,262,469 A * 4/1981 Ooms et al. ..... 53/76
4,541,888 A * 9/1985 Marchetti ..... 156/468
4,543,150 A * 9/1985 Marchetti ..... 156/468
4,545,175 A 10/1985 Beckett
4,584,818 A 4/1986 Plaskett
4,627,217 A 12/1986 Plaskett
4,656,810 A 4/1987 Plaskett
4,694,635 A * 9/1987 Marchetti ..... 53/136.4
4,735,302 A * 4/1988 Marchetti ..... 198/463.4
4,936,816 A 6/1990 Blumle et al.
5,102,382 A 4/1992 Center et al.
5,120,293 A 6/1992 Franklin
5,234,398 A 8/1993 Larsen
5,255,490 A * 10/1993 Chiu ..... 53/136.4

(Continued)

FOREIGN PATENT DOCUMENTS

FR 2697497 5/1994

*Primary Examiner*—John Sipos
(74) *Attorney, Agent, or Firm*—Schwartz & Weinrieb

(57) ABSTRACT

A new and improved case sealer assembly comprises a pair of oppositely disposed case drive mechanisms for conveying a multiplicity of cases through a sealing station. The drive mechanisms are laterally separated from each other such that an interior space is formed therebetween which effectively defines a sealing station for serially accommodating the multiplicity of cases to be sealed. The pair of drive mechanisms are mounted upon arms that are movably mounted in a linear manner so as to be capable of being manually adjusted toward and away from each other in a substantially infinite number of increments, and in addition, the arms are also pivotally mounted such that not only are the drive mechanisms manually movable toward or away from each other in order to initially adjust the lateral distance, defined between the pair of oppositely disposed drive mechanisms, to any one of an infinite number of predetermined dimensions whereby various different cartons or cases, having various, different predetermined width dimensions, can be accommodated by the case sealer assembly, but in addition, the pair of oppositely disposed drive mechanisms are mounted for automatic expansible movement with respect to each other so as to accommodate various different cases having various different width dimensions within a predetermined range of width dimensions.

15 Claims, 3 Drawing Sheets

U.S. PATENT DOCUMENTS 5,352,178 A 10/1994 Pazdernik
5,415,613 A 5/1995 McGrath
5,454,776 A * 10/1995 Ulrich et al. ..... 493/117
5,480,371 A * 1/1996 Morita et al. ..... 493/117
5,826,408 A 10/1998 Ford
5,868,308 A 2/1999 Briand
5,876,319 A 3/1999 Holton
5,916,106 A * 6/1999 Chen ..... 53/136.4
5,924,968 A 7/1999 Odenthal
6,309,335 B1 10/2001 Holton
6,352,252 B1 * 3/2002 Schmucker et al. ..... 270/58.07
6,599,225 B2 7/2003 Ammons et al.
6,622,461 B2 9/2003 Gambetti
6,764,436 B1 7/2004 Mazurek

* cited by examiner

CASE SEALER ASSEMBLY WITH SPRING-LOADED SIDE DRIVE MECHANISMS

FIELD OF THE INVENTION

The present invention relates generally to a case sealer assembly or apparatus for sealing the upper and lower flap members of a product-filled case or carton, and more particularly to a new and improved case sealer assembly or apparatus which is provided with a pair of oppositely disposed, longitudinally extending, endless-type conveyor belt drive mechanisms wherein the pair of oppositely disposed, longitudinally extending, endless-type conveyor belt drive mechanisms are adapted to engage the oppositely disposed external side surfaces of the product-filled cases or cartons so as to drive the product-filled cases or cartons through the case sealer assembly or apparatus in order to enable flap member sealing mechanisms of the case sealer assembly or apparatus, which may comprise, for example, suitable sealing tape cartridges, to seal the upper and lower flap members of each product-filled case or carton, and wherein further, the pair of oppositely disposed, longitudinally extending, endless-type conveyor belt drive mechanisms are pivotally mounted upon the framework of the case sealer assembly or apparatus, in a convergent manner as one proceeds downstream in the case or carton conveying direction extending from the entrance end portion of the case sealer assembly or apparatus to the exit end portion of the case sealer assembly or apparatus, and against spring-biasing mechanisms, whereby the pair of oppositely disposed, longitudinally extending, endless-type conveyor belt drive mechanisms can effectively diverge away from each other, as may be necessary, against the spring-biasing forces of the spring-biasing mechanisms, in order to permit the new and improved case sealer assembly or apparatus of the present invention to effectively accommodate cases or cartons having different width dimensions.

BACKGROUND OF THE INVENTION

In connection with the sealing of, for example, the upper and lower flap members of cases or cartons, into which a particular product has been deposited for shipment, transportation, or distribution, various types of case sealer assemblies or apparatus have been conventionally employed which effectively convey the cases or cartons, to be sealed, into and through a sealing station at which, for example, upper and lower flap member sealing mechanisms, comprising sealing tape cartridges, are disposed so as to in fact achieve the sealing of the upper and lower flap members of the cases or cartons. A significant operational drawback characteristic of such conventional, prior art case sealer assemblies or apparatus comprises, however, the fact that in order to accommodate and process various different cases or cartons having various, differently sized dimensions, the distance between the oppositely disposed drive mechanisms of the case sealer assembly or apparatus must be manually adjusted with respect to each other, when accommodating or processing various, differently sized cases or cartons, so as to in fact enable the case or carton drive mechanisms of the case sealer assembly or apparatus to properly engage the side wall portions of the particular case or carton to be sealed. More particularly, for example, if the interior width dimension of the case sealer assembly or apparatus is slightly smaller than the exterior width dimension of the particular case or carton being conveyed or driven through the sealing station of the case sealer assembly or apparatus, then there is a substantial likelihood that the particular case or carton will become stalled within the case sealer assembly or apparatus whereby continuous processing of cases or cartons through the case sealer assembly or apparatus will become jammed, or, still further, the particular case or carton will effectively be crushed within the case sealer assembly or apparatus. Conversely, if the interior width dimension of the case sealer assembly or apparatus is slightly greater than the exterior width dimension of the particular case or carton being conveyed or driven through the sealing station of the case sealer assembly or apparatus, then there is a substantial likelihood that the side wall portions of the particular case or carton will not be properly engaged by means of the drive mechanisms of the case sealer assembly or apparatus whereby, again, proper and continuous processing of the cases or cartons through the sealing station of the case sealer assembly or apparatus will be compromised.

A need therefore exists in the art for a new and improved case sealer assembly or apparatus wherein, not only can the disposition of the pair of oppositely disposed drive mechanisms, for propelling or conveying the multiplicity of cases or cartons through the sealing station of the case sealer assembly or apparatus, be manually moved toward or away from each other so as to initially adjust the lateral distance defined between the pair of oppositely disposed drive mechanisms to any one of an infinite number of predetermined dimensions whereby various different cases or cartons, having various, different predetermined width dimensions, can be accommodated by means of the case sealer assembly or apparatus, but in addition, the pair of oppositely disposed drive mechanisms can be mounted for automatic expansible movement with respect to each other such that for each predetermined interior width dimension of the case sealer assembly or apparatus, as defined between the pair of oppositely disposed drive mechanisms, manually adjusted with respect to each other, additional automatic adjustment of the interior width dimension, defined between the pair of oppositely disposed drive mechanisms, can be automatically achieved, without the need for further or additional manual adjustment of the pair of oppositely disposed drive mechanisms with respect to each other, whereby various different cartons or cases, having various different width dimensions within a predetermined range of width dimensions, can in fact be accommodated.

SUMMARY OF THE INVENTION

The foregoing and other objectives are achieved in accordance with the teachings and principles of the present invention through the provision of a new and improved case sealer assembly or apparatus which comprises a pair of oppositely disposed case or carton drive mechanisms for propelling or conveying a multiplicity of cases or cartons through a sealing station of the case sealer assembly or apparatus. The pair of oppositely disposed case or carton drive mechanisms are laterally separated from each other whereby an interior space is formed therebetween which effectively defines or serves as the sealing station for serially accommodating the multiplicity of cases or cartons to be sealed. The pair of oppositely disposed carton or case drive mechanisms are mounted upon arms which are movably mounted in a linear manner upon the framework of the case sealer assembly or apparatus so as to be capable of being manually adjusted toward and away from each other in a substantially infinite number of increments whereby the interior space defining or serving as the sealing station can selectively have any one of an infinite number of predetermined interior width dimensions. In addition, the arms, upon which the pair of oppositely disposed case or carton drive mechanisms are mounted, are also pivotally mounted upon the framework of the case sealer assembly or apparatus in accordance with spring-biasing forces.

Accordingly, not only are the pair of oppositely disposed drive mechanisms, for propelling or conveying the multiplicity of cases or cartons through the sealing station of the case sealer assembly or apparatus, manually movable toward or away from each other in order to initially adjust the lateral distance, defined between the pair of oppositely disposed drive mechanisms, to any one of an infinite number of predetermined dimensions whereby various different cartons or cases, having various, different predetermined width dimensions, can be accommodated by means of the case sealer assembly or apparatus, but in addition, the pair of oppositely disposed drive mechanisms are mounted for automatic expansible movement with respect to each other. In this manner, for each predetermined interior width dimension of the case sealer assembly or apparatus, as defined between the pair of oppositely disposed drive mechanisms which have been initially manually adjusted with respect to each other, additional automatic adjustment or expansion of the interior width dimension, defined between the pair of oppositely disposed drive mechanisms, can be achieved. Accordingly, various different cases or cartons, having various different width dimensions within a predetermined range of width dimensions, can in fact be accommodated by means of the case sealer assembly or apparatus of the present invention without the need for further or additional manual adjustment of the pair of oppositely disposed drive mechanisms with respect to each other.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
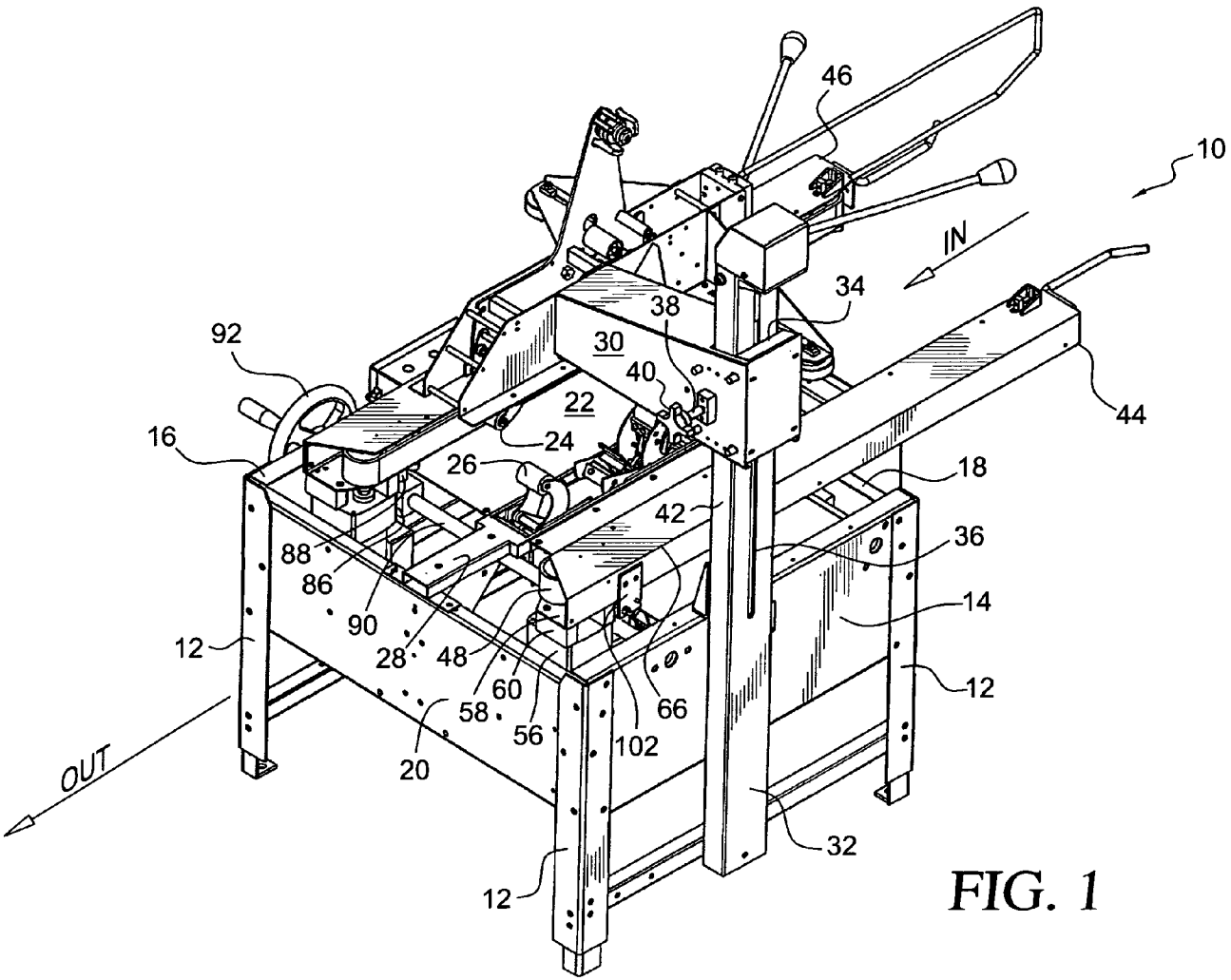
FIG. 1 is a perspective view of a new and improved case sealer assembly or apparatus as constructed in accordance with the principles and teachings of the present invention and showing the cooperative parts thereof.

Referring now to the drawings, and more particularly to FIG. 1 initially, a new and improved case sealer assembly or apparatus, as constructed in accordance with the principles and teachings of the present invention, is disclosed and is generally indicated by the reference character 10. More particularly, the new and improved case sealer assembly or apparatus 10 is seen to comprise a framework comprising a plurality of upstanding leg members 12 which are disposed within the four corner regions of the case sealer assembly or apparatus 10, a pair of oppositely disposed side wall members 14,16, and a pair of oppositely disposed end wall members 18,20. A case or carton sealing station 22 is effectively defined within a substantially central region of the case sealer assembly or apparatus 10, between the pair of oppositely disposed side wall members 14,16 and the pair of oppositely disposed end wall members 18,20, and it is further seen that an upper tape cartridge sealing mechanism 24 and a lower tape cartridge sealing mechanism 26 are disposed within the upper and lower regions of the case or carton sealing station 22 so as to in fact be capable of applying sealing tape to the upper and lower surface portions of the cases or cartons which are being serially conveyed through the case or carton sealing station 22 along a linear, longitudinally central conveyor path which is schematically illustrated by means of the arrows IN and OUT. It is noted that the lower tape cartridge sealing mechanism 26 is fixedly mounted upon, for example, the pair of oppositely disposed end wall members 18,20 of the case sealer assembly or apparatus framework by means of a pair of mounting brackets 28, only one of which is visible within FIG. 1, while the upper tape cartridge sealing mechanism 24 is seen to be fixedly mounted upon a head or carriage assembly 30 which is movably mounted upon a vertically oriented standard 32.

The vertically oriented standard 32 is fixedly secured to the side wall member 14 of the case sealer assembly or apparatus framework, and it is noted that the head or carriage assembly 30 has a passageway 34 defined therethrough such that the upper end portion of the vertically oriented standard 32 can correspondingly extend therethrough. A vertically oriented guide slot or keyway 36 is defined within the upper end portion of the vertically oriented standard 32 for accommodating and guiding a key member, not shown, which is provided upon the head or carriage assembly 30 and extends into the vertically oriented guide slot or keyway 36, and in this manner, the head or carriage assembly 30 is able to be guided, while being moved vertically upwardly and downwardly, along the vertically oriented standard 32 so as to effectively adjust the vertical disposition of the upper tape cartridge sealing mechanism 24 with respect to the lower tape cartridge sealing mechanism 26 in order to ensure that the upper and lower tape cartridge sealing mechanisms 24,26 properly and respectively engage the upper and lower surface portions of each case or carton being serially conveyed through the sealing station 22. In order to fixedly secure the head or carriage assembly 30 at a particularly selected elevational level, so as to effectively locate the upper tape cartridge sealing mechanism 24 at a particular distance with respect to the lower tape cartridge sealing mechanism 26 in order to accommodate a particular carton or case, to be sealed and having a predetermined height dimension, between the upper and lower tape cartridge sealing mechanisms 24,26, a set bolt 38, having an actuating knob 40, is rotatably mounted upon the head or carriage assembly 30 so as to forcefully engage an upper end portion of a side wall member 42 of the vertically oriented standard 32.

Continuing further, the new and improved case sealer assembly or apparatus 10 is seen to also comprise a pair of oppositely disposed, laterally spaced case or carton conveyor belt drive assemblies 44,46. The case or carton convey- or belt drive assemblies 44,46 are substantially identical to, but a mirror image of, each other, and therefore, a detailed description of one of the case or carton conveyor belt drive assemblies 44,46 will suffice as a disclosure for each one of the case or carton conveyor belt drive assemblies. More particularly, as can best be seen by means of additional reference being made to FIG. 2, the left side case or carton conveyor belt drive assembly 44, as viewed in the direction of conveyance along the case or carton conveyor path as schematically illustrated by means of the IN/OUT arrows, is seen to comprise an endless case or carton conveyor drive belt 48 which is disposed around a forwardly disposed convey- or belt drive roller 50 and a longitudinally spaced, rearwardly disposed conveyor belt idler roller 52. The conveyor belt drive roller 50 is fixedly mounted upon an upstanding output drive shaft 54 of a drive motor 56, and it is to be appreciated that the conveyor belt drive roller-drive motor assembly 50,56 are mounted upon the forward end portion of a longitudinally extending conveyor belt support arm 58, with a pair of spacers 60 being interposed between the upper end portion of the drive motor 56 and the undersurface portion of the conveyor belt support arm 58.

The conveyor belt support arm 58 is seen to comprise an angle iron or sheet metal member having a substantially L-shaped cross-sectional configuration comprising a substantially horizontally oriented member or section 62 and a substantially vertically oriented member or section 64, and a conveyor belt cover 66, also comprising, in effect, an angle iron or sheet metal member, is adapted to be fixedly secured to the conveyor belt support arm 58. More particularly, it is seen that the conveyor belt cover 66 comprises a substantially horizontally oriented member or section 68 and a substantially vertically oriented member or section 70 wherein the substantially vertically oriented member or section 70 of the conveyor belt cover 66 is adapted to be fixedly secured to the substantially vertically oriented member or section 64 of the conveyor belt support arm 58 by means of suitable fasteners, not shown. It is additionally seen that a spacer or backer plate 72 extends longitudinally between the forwardly disposed conveyor belt drive roller 50 and the rearwardly disposed conveyor belt idler roller 52, and that the spacer or backer plate 72 is adapted to be fixedly secured to both the substantially horizontally oriented member or section 68 of the conveyor belt cover 66 and the substantially horizontally oriented member or section 62 of the conveyor belt support arm 58 by means of a plurality of shaft members 74 which are respectively externally tapped or threaded upon their opposite ends so as to accommodate nut members 75. The plurality of shaft members 74 are adapted to respectively be disposed within and pass through a plurality of throughbores 76 which are defined within the spacer or backer plate 72. It is noted still further that the conveyor belt idler roller 52 is mounted upon a vertically oriented shaft 78 which has its oppositely disposed upper and lower end portions rotatably mounted within the substantially horizontally oriented member or section 68 of the conveyor belt cover 66 and the substantially horizontally oriented member or section 62 of the conveyor belt support arm 58 by means of a pair of vertically spaced bearing members 80,82. Accordingly, it can be appreciated that when the conveyor belt cover 66 is fixedly secured to the conveyor belt support arm 58, as a result of the substantially vertically oriented member or section 70 of the conveyor belt cover 66 being fixedly secured to the substantially vertically oriented member or section 64 of the conveyor belt support arm 58, as well as the substantially horizontally oriented member or section 68 of the conveyor belt cover 66 being fixedly secured to the substantially horizontally oriented member or section 62 of the conveyor belt support arm 58 through means of the spacer or backer plate 72 and the shaft members 74, the conveyor belt cover 66 and the conveyor belt support arm 58 together define a substantially C-shaped housing which effectively envelops the case or carton conveyor drive belt 48, the conveyor belt drive roller 50, the conveyor belt idler roller 52, and the spacer or backer plate 72, as can best be appreciated from FIG. 1.

Figure 2:
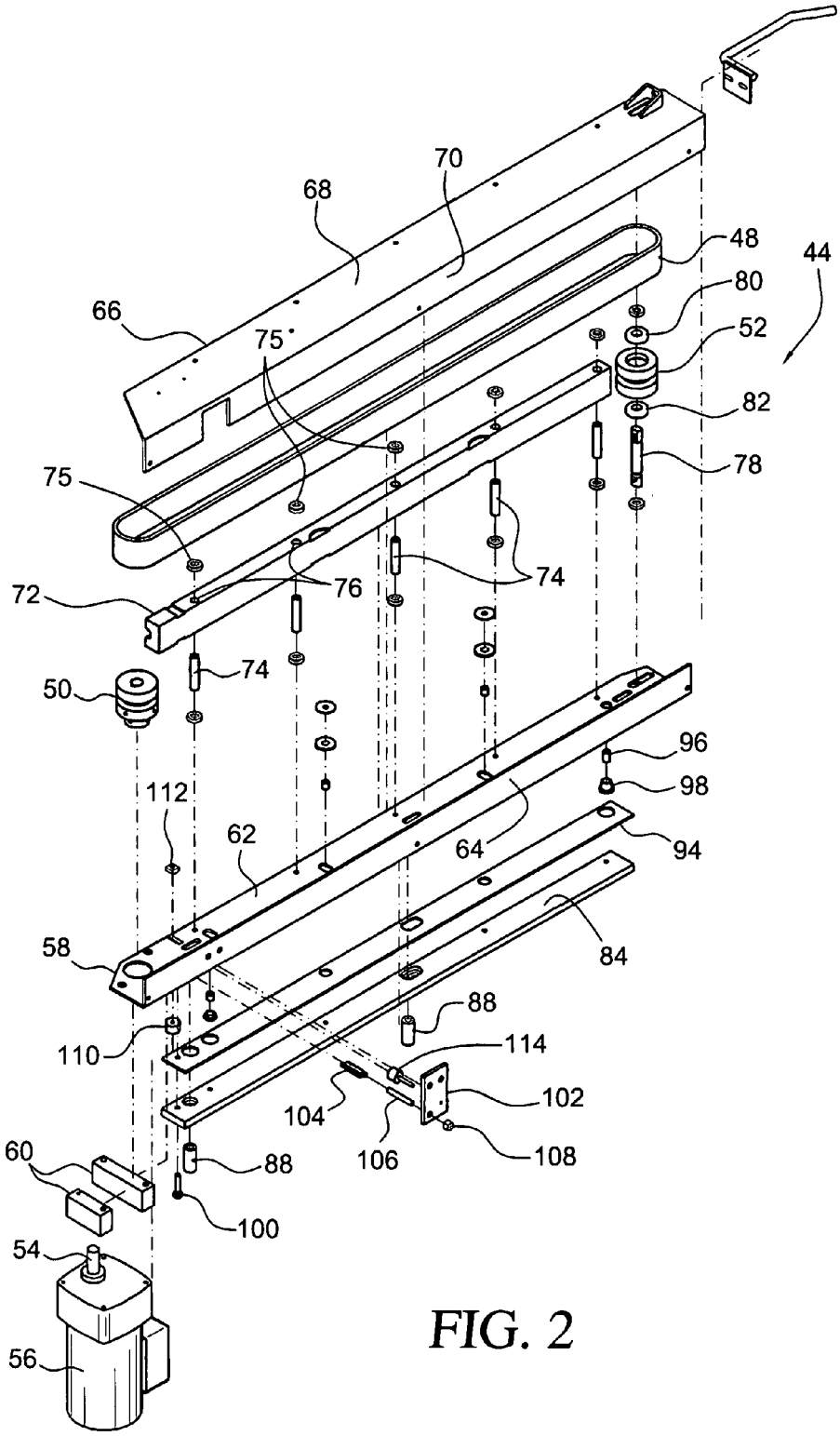
FIG. 2 is an exploded view of one of the pair of laterally spaced, oppositely disposed drive mechanisms, of the new and improved case sealer assembly or apparatus as disclosed within FIG. 1, for propelling or conveying various different cases or cartons, having various different width dimensions within a predetermined range of width dimensions, through the sealing station of the new and improved case sealer assembly or apparatus, as disclosed within FIG. 1, without the need for manually adjusting the pair of laterally spaced, oppositely disposed drive mechanisms with respect to each other.

Continuing further, and in accordance with the unique and novel structural features characteristic of the present invention, each one of the pair of oppositely disposed, laterally spaced case or carton conveyor belt drive assemblies 44,46 is seen to also comprise a base plate 84 wherein the pair of oppositely disposed, laterally spaced base plates 84 are adapted to be mounted upon the framework of the case sealer assembly or apparatus 10 so as to be capable of undergoing transverse or lateral movement toward and away from each other. More particularly, the forward end and central portions of each one of the oppositely disposed, laterally spaced base plates 84 are seen to be respectively mounted upon a pair of longitudinally spaced mounting blocks, only one of which is visible within FIG. 1 as at 86, by means of suitable fasteners, not shown, which pass through tubular bushings or spacers 88 which are best seen in FIG. 2. In turn, each one of the pair of oppositely disposed, laterally or transversely spaced mounting blocks 86, respectively mounted beneath the forward and central portions of each base plate 84 of each one of the case or carton conveyor belt drive assemblies 44,46, is internally threaded and the plurality of mounting blocks 86 are disposed in opposed pairs and are mounted upon forwardly disposed and centrally disposed drive screws 90, only the forwardly disposed drive screw 90 being visible within FIG. 1, wherein the drive screws 90 have their oppositely disposed, terminal end portions rotatably mounted upon the apparatus framework.

In addition, the left side portions of the longitudinally spaced drive screws 90, as viewed in the direction of conveyance along the case or carton conveyor path as schematically illustrated by means of the IN/OUT arrows, are adapted to be operatively connected together by a suitable drive means, such as, for example, a drive chain and sprocket assembly, not shown, and each one of the pair of longitudinally spaced, forwardly and centrally disposed drive screws 90 comprises oppositely threaded, laterally or transversely spaced side portions. It can be further appreciated that the terminal end of the right side portion of the forwardly disposed drive screw 90 is operatively connected to a manually rotatable handle 92. In this manner, it can be appreciated still further that when the manually rotatable handle 92 is rotated in either one of the opposite clockwise or counterclockwise directions, the rotation of the longitudinally spaced forwardly and centrally disposed threaded drive screws 90, as interconnected together by means of the aforenoted drive chain and sprocket assembly, not shown, will cause each pair of mounting blocks 86, respectively threadedly disposed upon each one of the longitudinally spaced forwardly and centrally disposed threaded drive screws 90, to move toward and away from each other whereby the pair of oppositely disposed base plates 84, of the pair of oppositely disposed, laterally spaced case or carton conveyor belt drive assemblies 44,46, will be moved toward and away from each other so as to, in turn, adjust the lateral or transverse distance defined between the pair of oppositely disposed, laterally spaced case or carton conveyor belt drive assemblies 44,46. In this manner, various, differently sized cases or cartons can be accommodated between the pair of oppositely disposed, laterally spaced case or carton conveyor belt drive assemblies 44,46 when various, differently sized cases or cartons are to be disposed at the sealing station 22 so as to undergo a case or carton sealing operation.

Figure 3:
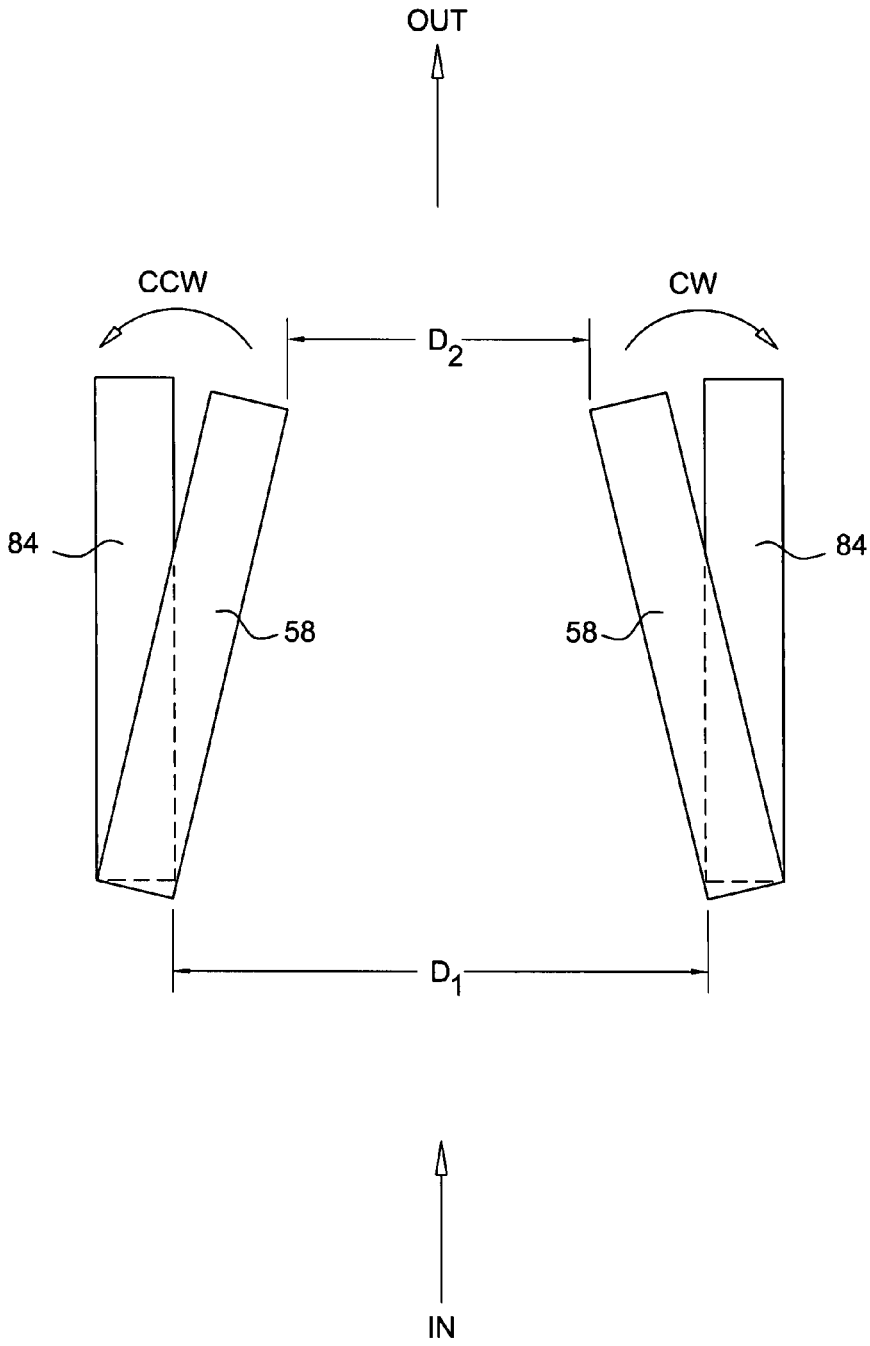
FIG. 3 is a schematic top plan view of the pair of laterally separated, oppositely disposed, longitudinally extending conveyor belt support arms, having the pair of laterally separated, oppositely disposed, longitudinally extending conveyor belts respectively mounted thereon, wherein the pair of laterally separated, oppositely disposed, longitudinally extending conveyor belt support arms, having the pair of laterally separated, oppositely disposed, longitudinally extending conveyor belts respectively mounted thereon, are adapted for pivotal movement with respect to the pair of laterally separated, oppositely disposed, longitudinally extending base plates so as to be movable between their relatively innermost convergent positions and their relatively outermost parallel positions with respect to each other.

Continuing still further, and in accordance with additional unique and novel structural features characteristic of the present invention, each one of the oppositely disposed conveyor belt support arms 58, along with its conveyor drive belt 48, its conveyor belt drive roller 50, its convey- or belt idler roller 52, its spacer or backer plate 72, its conveyor belt cover 66, and its conveyor belt drive motor 56, is adapted to be respectively pivotally mounted, within a horizontally extending plane, upon each one of the pair of oppositely disposed, laterally spaced case or carton conveyor belt drive assemblies 44,46. More particularly, as can be additionally appreciated from FIG. 3, the pair of conveyor belt support arms 58, along with their conveyor drive belts 48, their conveyor belt drive rollers 50, their conveyor belt idler rollers 52, their spacer or backer plates 72, their conveyor belt covers 66, and their conveyor belt drive motors 56, are adapted to be respectively mounted upon the pair of oppositely disposed, laterally spaced case or carton conveyor belt drive assemblies 44,46 in a relatively convergent manner, as viewed in the direction of conveyance along the case or carton conveyor path as schematically illustrated by means of the IN/OUT arrows.

In this manner, not only are the rearwardly disposed or upstream entrance end portions of the pair of oppositely disposed conveyor belt support arms 58, as well as the rearwardly disposed or upstream entrance end portions of the conveyor drive belts 48, of the pair of oppositely disposed, laterally spaced case or carton conveyor belt drive assemblies 44,46, disposed further apart from each other, as denoted by means of, for example, transverse dimension $D_1$, than the forwardly disposed or downstream exit end portions of the pair of oppositely disposed conveyor belt support arms 58, and the forwardly disposed or downstream exit end portions of the conveyor drive belts 48, of the pair of oppositely disposed, laterally spaced carton or case conveyor belt drive assemblies 44,46, as denoted by means of, for example, transverse dimension $D_2$, but in addition, the forwardly disposed or downstream exit end portions of the pair of oppositely disposed conveyor belt support arms 58, and the forwardly disposed or downstream exit end portions of the conveyor drive belts 48, of the pair of oppositely disposed, laterally spaced case or carton conveyor belt drive assemblies 44,46, are effectively movable within a common horizontal plane between predetermined laterally or transversely innermost positions and predetermined laterally or transversely outermost positions with respect to the respective base plates 84 of the pair of oppositely disposed, laterally spaced case or carton conveyor belt drive assemblies 44,46 so as to accommodate various, differently sized cases or cartons within a predetermined size range.

More particularly, a bearing plate 94 is adapted to be fixedly attached atop each one of the base plates 84 so as to effectively define a bearing surface for the undersurface portion of each one of the pair of oppositely disposed conveyor belt support arms 58. A pivot pin 96, disposed within a bearing member 98, pivotally mounts the rearwardly disposed or upstream entrance end portion of each one of the pair of oppositely disposed conveyor belt support arms 58 upon a rearwardly disposed or upstream end portion of each bearing plate 94, while an upstanding pin or lug 100 is fixedly mounted within forwardly disposed or downstream end portions of each one of the base plates 84 and their operatively associated bearing plates 94. A mounting bracket 102 is adapted to be fixedly mounted upon a forwardly disposed or downstream end portion of the substantially vertically oriented leg member-64 of each one of the pair of oppositely disposed convey- or belt support arms 58, and a coil spring 104 is interposed between the upstanding pin or lug 100 and the mounting bracket 102. One eyelet end of the coil spring 104 is adapted to be fixedly secured to the upstanding pin or lug 100, while the opposite eyelet end of the coil spring 104 is adapted to be fixedly secured to a threaded stud 106 which passes or extends through the mounting bracket 102. A wing nut 108 is threadedly engaged upon the free end portion of the threaded stud 106 and engages the mounting bracket 102 so as to effectively adjust the tension of the coil spring 104 as the nut 108 is threadedly adjusted upon the threaded stud 106.

A first positional bumper 110 is fixedly mounted upon an undersurface portion of each one of the substantially horizontally oriented leg members 62 of each one of the pair of oppositely disposed conveyor belt support arms 58, by means of a suitable fastener, not shown, and a nut member 112, so as to be disposed upon the internal side of each one of the base plates 84, and a second positional bumper 114 is fixedly mounted upon the mounting bracket 102 so as to effectively be disposed upon the external side of each one of the base plates 84. Accordingly, it can be appreciated that the pair of coil springs 104, respectively mounted upon the pair of oppositely disposed, laterally spaced carton or case conveyor belt drive assemblies 44,46, will normally bias the forwardly disposed or downstream end portions of the pair of oppositely disposed conveyor belt support arms 58, along with their conveyor drive belts 48, toward their innermost converged positions until the second positional bumpers 114 respectively engage the external side edge portions of the base plates 84 so as to in fact define, for example, the innermost positions of the forwardly disposed or downstream end portions of the pair of oppositely disposed, laterally or transversely spaced conveyor drive belts 48 with respect to each other. At this point in time, the first positional bumpers 110 will be respectively disengaged from the internal side edge portions of the base plates 84.

In this manner, when a particular case or carton is conveyed into the sealing station 22 by means of a conventional delivery conveyor, not shown, which conveys the case or carton along the conveyance path defined by means of the IN/OUT arrows, the pair of oppositely disposed, laterally or transversely spaced conveyor drive belts 48 will effectively receive the case or carton from the conventional delivery conveyor, not shown, and further convey the case or carton into and out from the sealing station 22 in accordance with case or carton sealing procedures. It is to be appreciated that as a result of the forwardly disposed or downstream end portions of the pair of oppositely disposed, transversely or laterally spaced conveyor drive belts 48 being disposed at their innermost positions with respect to each other, a first case or carton, having a predeterminedly small size width dimension may be processed by means of the case sealer assembly or apparatus 10 of the present invention, however, if a second case or carton, having a slightly larger width dimension than that of the first case or carton, is to be processed by means of the case sealer assembly or apparatus 10 of the present invention, then the second case or carton can nevertheless be conveyed into and through the sealing station 22, without becoming jammed or stalled within the case sealer assembly or apparatus 10, as a result of the second case or carton effectively causing the automatic forceful outward pivotal expansion of the pair of oppositely disposed conveyor belt support arms 58, along with their conveyor drive belts 48, with respect to each other and against the biasing forces of coil springs 104 as denoted by means of the oppositely oriented clockwise and counter-clockwise arrows CW and CCW in FIG. 3. It is to be noted that such outward expansion of each one of the pair of oppositely disposed conveyor belt support arms 58, along with their conveyor drive belts 48, is limited by means of the first positional bumpers 110, which will then engage the internal side edge portions of the base plates 84.

Subsequently, when the second larger-sized case or carton has been sealed and passed through the sealing station 22, the coil springs 104 will effectively return the pair of oppositely disposed conveyor belt support arms 58, along with their conveyor drive belts 48, to their innermost positions until the second positional bumpers 114 once again engage the external side edge portions of the base plates 84 so as to, in turn, again position the forwardly disposed or downstream end portions of the pair of oppositely disposed conveyor belt support arms 58, along with the forwardly disposed or down-stream end portions of the pair of conveyor drive belts 48, at their innermost converged positions. It is to be noted still further that the distance through which each one of the forwardly disposed or downstream end portions of the pair of oppositely disposed conveyor belt support arms 58 and the pair of oppositely disposed, transversely or laterally spaced conveyor drive belts 48 can travel or traverse, as a result of the aforenoted outward expansion or pivotal movement of the pair of oppositely disposed conveyor belt support arms 58 and the pair of oppositely disposed, transversely or laterally spaced conveyor drive belts 48 between their innermost and outermost positions can comprise, for example, approximately one half inch (0.500"), and therefore, the distance defined between the forwardly disposed or downstream end portions of the pair of oppositely disposed conveyor belt support arms 58 and the pair of oppositely disposed, transversely or laterally spaced conveyor drive belts 48 can effectively be increased or expanded by means of approximately one inch (1.00").

Accordingly, for any particular or predetermined manual adjustment or setting of the pair of oppositely disposed conveyor belt support arms 58, and the pair of oppositely disposed, transversely or laterally spaced conveyor drive belts 48 mounted thereon, as achieved by means of the manually operated handle 92, and the movement of the mounting blocks 86 along the transversely oriented drive screws 90, the size range of cases or cartons which can be accommodated within the sealing station 22 can effectively be expanded by means of approximately one inch (1.00") without the need for any further adjustment of the pair of oppositely disposed conveyor belt support arms 58, and the pair of oppositely disposed, transversely or laterally spaced conveyor drive belts 48 mounted thereon, in order to accommodate each individual case or carton to be sealed. Of course, if a third case or carton to be sealed at the sealing station 22, is to be conveyed into and processed within the sealing station 22, wherein the width dimension of the third case or carton is larger than the width dimensions of the first or second cases or cartons by more than, for example, the approximate one inch (1.00") expansion range that can be accommodated by means of the pair of oppositely disposed, pivotally mounted conveyor belt support arms 58, then manual adjustment of the pair of oppositely disposed conveyor belt support arms 58, to be achieved by means of the manually operated handle 92, and the movement of the mounting blocks 86 along the transversely oriented drive screws 90, must be performed.

Thus, it may be seen that in accordance with the principles and teachings of the present invention, there has been disclosed a new and improved case sealer assembly or apparatus which comprises a pair of oppositely disposed case or carton drive mechanisms for propelling or conveying a multiplicity of cases or cartons through a sealing station of the case sealer assembly or apparatus. The pair of oppositely disposed case or carton drive mechanisms are laterally separated from each other whereby an interior space is formed therebetween which effectively defines or serves as the sealing station for serially accommodating the multiplicity of cases or cartons to be sealed. The pair of oppositely disposed carton or case drive mechanisms are mounted upon arms that are movably mounted in a linear manner upon the framework of the case sealer assembly or apparatus so as to be capable of being manually adjusted toward and away from each other in a substantially infinite number of increments whereby the interior space defining or serving as the sealing station can selectively have any one of an infinite number of predetermined interior width dimensions, however, in addition, the arms, upon which the pair of oppositely disposed case or carton drive mechanisms are mounted, are also pivotally mounted upon the framework of the case sealer assembly or apparatus in accordance with spring-biasing forces.

Accordingly, not only are the pair of oppositely disposed drive mechanisms, for propelling or conveying the multiplicity of cases or cartons through the sealing station of the case sealer assembly or apparatus, manually movable toward or away from each other in order to initially adjust the lateral distance, defined between the pair of oppositely disposed drive mechanisms, to any one of an infinite number of predetermined dimensions whereby various different cartons or cases, having various, different predetermined width dimensions, can be accommodated by means of the case sealer assembly or apparatus, but in addition, the pair of oppositely disposed drive mechanisms are mounted for automatic expansible movement with respect to each other. In this manner, for each predetermined interior width dimension of the case sealer assembly or apparatus, as defined between the pair of oppositely disposed drive mechanisms which have been initially manually adjusted with respect to each other, additional automatic adjustment or expansion of the interior width dimension, defined between the pair of oppositely disposed drive mechanisms, can be achieved. Accordingly, various different cases or cartons, having various different width dimensions within a predetermined range of width dimensions, can in fact be accommodated by means of the case sealer assembly or apparatus of the present invention without the need for further or additional manual adjustment of the pair of oppositely disposed drive mechanisms with respect to each other.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Apparatus for sealing cases, comprising:

a framework defining a sealing station therewithin, within which a case is adapted to be sealed;

sealing means disposed at said sealing station for sealing a case at said sealing station as a case is conveyed through said sealing station;

a pair of laterally separated, oppositely disposed, longitudinally extending conveyor belt drive means, comprising a pair of laterally separated, oppositely disposed, longitudinally extending conveyor belts, for engaging a case to be sealed and for conveying a case through said sealing station along a longitudinally extending path such that the case can be sealed by said sealing means disposed at said sealing station;

first means for mounting said pair of laterally separated, oppositely disposed conveyor belt drive means upon said framework such that said pair of laterally separated, oppositely disposed conveyor belt drive means can be adjusted in incremental amounts, toward and away from each other, so as to effectively define a plurality of width dimensions within said sealing station, as defined between said pair of laterally separated, oppositely disposed conveyor belt drive means, whereby different cases having different width dimensions can be accommodated within said sealing station; and second means for pivotally mounting said pair of laterally separated, oppositely disposed conveyor belt drive means upon said framework such that for each incremental adjustment of said pair of laterally separated, oppositely disposed conveyor belt drive means by said first means, said second means for pivotally mounting said pair of laterally separated, oppositely disposed conveyor belt drive means upon said framework permits said pair of laterally separated, oppositely disposed conveyor belt drive means to undergo a predetermined amount of expansion whereby different cases, having different width dimensions which are within a predetermined range of width dimensions beyond said width dimension as defined by said pair of laterally separated, oppositely disposed conveyor belt drive means having been adjusted to a particular incremental amount by said first means, can be accommodated within said sealing station.

2. The apparatus as set forth in claim 1, wherein:

said sealing means comprises vertically spaced up-per and lower tape cartridge sealing mechanisms disposed at said sealing station.

3. The apparatus as set forth in claim 2, further comprising:

vertically adjustable carriage means for mounting said upper tape cartridge sealing mechanism thereon in order to adjust the vertical disposition of said upper tape cartridge sealing mechanism with respect to said lower tape cartridge sealing mechanism.

4. The apparatus as set forth in claim 1, wherein said first means for mounting said pair of late-rally separated, oppositely disposed conveyor belt drive means upon said framework, comprises:

a plurality of mounting blocks upon which said pair of laterally separated, oppositely disposed, longitudinally extending conveyor belts are mounted; and screw drive means, having oppositely oriented threaded portions defined thereon, threadedly engaged with said plurality of mounting blocks such that said plurality of mounting blocks, and said pair of laterally separated, oppositely disposed, longitudinally extending conveyor belts mounted upon said mounting blocks, can be moved toward and away from each other, depending upon the direction in which said screw drive means is rotated, so as to adjust the width dimension of said sealing station as defined between said pair of laterally separated, oppositely disposed, longitudinally extending conveyor belts.

5. The apparatus as set forth in claim 4, wherein said second means for pivotally mounting said pair of laterally separated, oppositely disposed conveyor belt drive means upon said framework comprises:

means for pivotally mounting said pair of laterally separated, oppositely disposed, longitudinally extending conveyor belts upon said framework for pivotal movement, within a common plane defined by said pair of laterally separated, oppositely disposed, longitudinally extending conveyor belts, between relatively innermost and relatively outermost positions.

6. The apparatus as set forth in claim 5, wherein said pair of laterally separated, oppositely disposed conveyor belt drive means further comprises:

a pair of laterally separated, oppositely disposed, longitudinally extending conveyor belt support arms;

a conveyor belt drive roller rotatably disposed up-on a forward, downstream end portion of each one of said pair of laterally separated, oppositely disposed, longitudinally extending conveyor belt support arms;

a conveyor belt idler roller rotatably disposed upon a rearward, upstream end portion of each one of said pair of laterally separated, oppositely disposed, longitudinally extending conveyor belt support arms;

each one of said pair of laterally separated, oppositely disposed, longitudinally extending conveyor belts being disposed around one of said conveyor belt drive rollers and one of said conveyor belt idler rollers; and a drive motor suspendingly supported upon said for-ward, downstream end portion of each one of said pair of laterally separated, oppositely disposed, longitudinally ex-tending conveyor belt support arms for respective operative connection to each one of said conveyor belt drive rollers.

7. The apparatus as set forth in claim 6, further comprising:

a pair of laterally separated, oppositely disposed, longitudinally extending base plates fixedly mounted upon said plurality of mounting blocks; and means for pivotally mounting said pair of laterally separated, oppositely disposed, longitudinally extending conveyor belt support arms upon said pair of laterally separated, oppositely disposed, longitudinally extending base plates.

8. The apparatus as set forth in claim 7, further comprising:

spring biasing means, respectively mounted upon each one of said pair of laterally separated, oppositely disposed, longitudinally extending base plates for normally respectively biasing each one of said pair of laterally separated, oppositely disposed, longitudinally extending conveyor belt support arms, and said pair of laterally separated, oppositely disposed, longitudinally extending conveyor belts respectively mounted upon said pair of laterally separated, oppositely disposed, longitudinally extending conveyor belt support arms, toward said relatively innermost positions, and for automatically permitting outward expansion of said pair of laterally separated, oppositely disposed, longitudinally extending conveyor belt support arms, and said pair of late-rally separated, oppositely disposed, longitudinally extending conveyor belts respectively mounted upon said pair of laterally separated, oppositely disposed, longitudinally ex-tending conveyor belt support arms, with respect to each other toward said relatively outermost positions.

9. The apparatus as set forth in claim 8, further comprising:

first and second bumper means, respectively mounted upon each one of said pair of laterally separated, oppositely disposed, longitudinally extending conveyor belt support arms, for respectively engaging each one of said pair of laterally separated, oppositely disposed, longitudinally ex-tending base plates so as to limit and define said relatively innermost and relatively outermost positions of said pair of laterally separated, oppositely disposed, longitudinally ex-tending conveyor belt support arms and said pair of laterally separated, oppositely disposed, longitudinally extending conveyor belts respectively mounted upon said pair of laterally separated, oppositely disposed, longitudinally extending conveyor belt support arms.

10. The apparatus as set forth in claim 9, wherein:

the range of movement for each one of said pair of laterally separated, oppositely disposed, longitudinally ex-tending conveyor belt support arms, and each one of said pair of laterally separated, oppositely disposed, longitudinally extending conveyor belts respectively mounted upon said pair of laterally separated, oppositely disposed, longitudinally extending conveyor belt support arms, between said relatively innermost and relatively outermost positions comprises ap-proximately one-half inch such that the range of movement for said pair of laterally separated, oppositely disposed, longitudinally extending conveyor belt support arms, and said pair of laterally separated, oppositely disposed, longitudinally extending conveyor belts respectively mounted upon said pair of laterally separated, oppositely disposed, longitudinally extending conveyor belt support arms, as defined between said pair of laterally separated, oppositely disposed, longitudinally extending conveyor belt support arms, and said pair of laterally separated, oppositely disposed, longitudinally ex-tending conveyor belts respectively mounted upon said pair of laterally separated, oppositely disposed, longitudinally extending conveyor belt support arms, is approximately one inch.

11. The apparatus as set forth in claim 9, wherein:

rearward, upstream end portions of said pair of laterally separated, oppositely disposed, longitudinally extending conveyor belts are pivotally mounted upon said frame-work while forward, downstream end portions of said pair of laterally separated, oppositely disposed, longitudinally ex-tending conveyor belts are pivotally movable toward and away from each other so as to be movable between said relatively innermost and relatively outermost positions.

12. The apparatus as set forth in claim 11, wherein:

said pair of laterally separated, oppositely disposed, longitudinally extending conveyor belts are normally disposed in a convergent manner such that said pair of late-rally separated, oppositely disposed, longitudinally extending conveyor belts have a substantially V-shaped configuration with respect to each other wherein said rearward, up-stream end portions of said pair of laterally separated, oppositely disposed, longitudinally extending conveyor belts being disposed further apart from each other than said for-ward, downstream end portions of said pair of laterally separated, oppositely disposed, longitudinally extending conveyor belts, when said forward, downstream end portions of said pair of laterally separated, oppositely disposed, longitudinally extending conveyor belts are disposed at said relatively innermost positions.

13. The apparatus as set forth in claim 12, wherein:

said pair of laterally separated, oppositely disposed, longitudinally extending conveyor belts are disposed substantially parallel with respect to each other when said forward, downstream end portions of said pair of laterally separated, oppositely disposed, longitudinally extending conveyor belts are disposed at said relatively outermost positions.

14. The apparatus as set forth in claim 7, further comprising:

bearing plate means interposed between each one of said pair of laterally separated, oppositely disposed, longitudinally extending conveyor belt support arms and each one of said pair of laterally separated, oppositely disposed, longitudinally extending base plates for permitting each one of pair of laterally separated, oppositely disposed, longitudinally extending conveyor belt support arms to be pivotal-ly movable with respect to each one of said pair of laterally separated, oppositely disposed, longitudinally extending base plates.

15. The apparatus as set forth in claim 12, wherein:

said rearward, upstream end portions of said pair of laterally separated, oppositely disposed, longitudinally extending conveyor belts are normally disposed apart from each other by means of a distance which is greater than the width dimension of the case to be sealed so as to permit the case to be sealed to easily enter said sealing station and be conveyed along said longitudinally extending path by said pair of laterally spaced, oppositely disposed, longitudinally extending conveyor belts, whereas if said forward, downstream end portions of said pair of laterally separated, oppositely disposed, longitudinally extending conveyor belts, normally disposed at said innermost positions, are disposed apart from each other by means of a distance which is less than the width dimension of the case to be sealed, said forward, down-stream end portions of said pair of laterally separated, oppositely disposed, longitudinally extending conveyor belts will be forced to pivot outwardly with respect to each other from said innermost positions toward said outermost positions so as to accommodate the case to be sealed as the case to be sealed is conveyed, along said longitudinally extending path, through said sealing station by said pair of laterally spaced, oppositely disposed, longitudinally extending conveyor belts.

* * * * *